US006616361B2

(12) United States Patent
Sugiyama

(10) Patent No.: US 6,616,361 B2
(45) Date of Patent: Sep. 9, 2003

(54) INK JET RECORDING APPARATUS

(75) Inventor: Noriyuki Sugiyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,845

(22) Filed: Jun. 26, 2002

(65) Prior Publication Data

US 2003/0025777 A1 Feb. 6, 2003

Related U.S. Application Data

(63) Continuation of application No. 09/388,429, filed on Sep. 2, 1999, now abandoned.

(30) Foreign Application Priority Data

Sep. 7, 1998 (JP) ..... 10-252268
Sep. 21, 1998 (JP) ..... 10-266727

(51) Int. Cl.[7] ..... B41J 13/10
(52) U.S. Cl. ..... 400/642; 400/611; 347/104
(58) Field of Search ..... 400/608.2, 611, 400/578, 624, 625, 629, 636, 642, 646; 347/101–104; 271/188, 207, 209

(56) References Cited

U.S. PATENT DOCUMENTS

| | | | | |
|---|---|---|---|---|
| 5,393,151 | A | 2/1995 | Martin et al. | 400/642 |
| 5,515,094 | A | 5/1996 | Tanaka et al. | 347/104 |
| 5,648,807 | A | 7/1997 | Saito et al. | 347/102 |
| 5,805,176 | A | 9/1998 | Saito et al. | 347/8 |
| 5,807,003 | A | 9/1998 | Kobayashi et al. | 400/625 |
| 5,816,716 | A | 10/1998 | Sugiyama | 400/76 |
| 5,874,979 | A | 2/1999 | Ohyama | 347/104 |
| 6,042,106 | A | 3/2000 | Kelly et al. | 271/188 |
| 6,095,516 | A | 8/2000 | Sawano et al. | 271/207 |
| 6,113,289 | A | 9/2000 | Saito et al. | 400/58 |

FOREIGN PATENT DOCUMENTS

JP 6-115195 4/1994

*Primary Examiner*—Andrew H. Hirshfeld
*Assistant Examiner*—Minh H. Chau
(74) *Attorney, Agent, or Firm*—Fitzpatrick, Cella, Harper & Scinto

(57) ABSTRACT

An ink jet recording apparatus using ink to be discharged from a plurality of ink discharge ports of a recording head comprises a holding unit for holding the recording head for recording on a recording sheet; a conveyor for conveying the recording sheet; and a recording sheet supporting member arranged at the position to face the recording head. The recording sheet supporting member is provided with a supporting surface to support the non-recording surface of the recording sheet, and is arranged in a direction intersecting the conveying direction of the recording sheet. The recording sheet supporting member is provided with a first extrusion and a second extrusion extended in the conveying direction of the recording sheet, and having inclined surfaces that incline toward the recording sheet supporting member from the supporting surface toward the upstream side relative to the conveying direction, and angles of inclination are made different for the inclined surfaces of the first extrusion and the second extrusion. With the structure thus arranged, the recording apparatus is able to convey a recording sheet reliably without allowing it to contact the recording head, resulting in a better recording and sheet conveying condition.

30 Claims, 8 Drawing Sheets

INK JET RECORDING APPARATUS

This application is a continuation of application Ser. No. 09/388,429 filed Sep. 2, 1999, now abandoned.

BACKGROUND OF THE INVENTION

1. Field of the Invention

The present invention relates to an ink jet recording apparatus that records on a recording sheet by ink jet recording means for discharging ink from ink discharge ports. More particularly, the invention relates to an ink jet recording apparatus capable of providing fine undulations in the recording sheet prior to ink jet recording, with the sheet being subjected to deformation when discharged ink is received thereon.

2. Related Background Art

Conventionally, it has been proposed to provide the platen of the ink jet recording apparatus with irregularities, such as disclosed in Japanese Patent Laid-Open Application No. 6-115195, in order to remove wrinkles or undulated deformation (hereinafter referred to as cockling) when ink is discharged onto a recording sheet.

Now, in conjunction with FIG. 15 and FIG. 16, description will be made of the conventional ink jet recording apparatus. The ink jet recording apparatus 100 shown in FIG. 15 is provided with carrier rollers 102 and 103, which serve as sheet conveying means on the upstream side of ink jet recording means 101 relative to the sheet conveying direction, and with exhaust roller 104 and spur 105 on the downstream side of the ink jet recording means.

Also, a platen 106 is arranged in a position to face the ink jet recording means 101. Extrusions 106*a* are arranged on the upper face of the platen, that is, the surface that faces the discharge port surface 101*a* of the ink jet recording means. Each of the extrusions 106*a* is formed on an inclined face which rises in the sheet conveying direction. In this way, it is possible to convey the sheet P in a path following the platen.

With the structure described above, however, recording is performed in a state where the sheet is inclined relative to the discharge port surface 101*a* of the ink jet recording means 101, because the sheet P follows the extrusions 106*a*. Thus, the distance in which ink is discharged from the discharge port surface 101*a* and impacted on the surface of the sheet P varies in the upstream side and downstream side of the sheet relative to the sheet conveying direction. As a result, the impact positions of the ink tend to vary accordingly, thus creating color deviation in some cases.

Also, before and after the sheet P is pinched by the exhaust roller 104 and the spur 105, the distance between the discharge port surface 101*a* and the sheet changes extremely to make it impossible to perform recording. If recording should be effected on this portion, discontinuation occurs in the recorded images in some cases due to the changed recording condition.

SUMMARY OF THE INVENTION

The present invention is designed in consideration of the problems discussed above. It is an object of the invention to provide an ink jet recording apparatus capable of conveying a recording sheet reliably without allowing it to be in contact with the recording head using structure for improving the recording condition and the sheet conveying condition.

It is another object of the invention to provide an ink jet recording apparatus capable of obtaining recorded images in good condition without creating color deviations or the like by maintaining a stable distance between recording means and a recording sheet.

It is still another object of the invention to provide an ink jet recording apparatus using ink to be discharged from a plurality of ink discharge ports of recording means which comprises holding means for holding recording means for recording on a recording sheet; conveying means for conveying the recording sheet; and a recording sheet supporting member arranged in the position to face the recording means which is provided with a supporting surface to support the non-recording surface of the recording sheet, and arranged in the direction intersecting the conveying direction of the recording sheet. The recording sheet supporting member has a first extrusion and a second extrusion extended in the conveying direction of the recording sheet, at the same time, being provided with the inclined surfaces becoming lower to the recording sheet supporting member from the supporting surface toward the upstream side in the conveying direction, and the angles of inclination are different for the inclined surfaces of the first extrusion and the second extrusion.

It is a further object of the invention to provide a recording apparatus provided with holding means for holding recording means for recording on a recording sheet; conveying means for conveying the recording sheet; and a recording sheet supporting member arranged in the position to face the recording means, being provided with a plurality of extrusions to support the upper surface of the non-recording surface of the recording sheet conveyed by the conveying means, which comprises:

a first extrusion arranged for the recording sheet supporting member to support the end portion of the recoding sheet in the width direction; and a plurality of second extrusions arranged for the recording sheet supporting member to convexly support a part of the recording sheet in the width direction toward the recording means side.

It is still a further object of the invention to provide a recording apparatus provided with holding means for holding recording means for recording on a recording sheet; conveying means for conveying the recording sheet; and a recording sheet supporting member arranged in the position to face the recording means, being provided with a plurality of extrusions to support the upper surface of the non-recording surface of the recording sheet conveyed by the conveying means, which comprises:

a first extrusion arranged for the recording sheet supporting member to support the side end portion of the recording sheet in the conveying direction of the recording sheet;

a plurality of second extrusions arranged for the recording sheet supporting member to convexly support a part of the recording sheet in the width direction toward the recording means side; and a third extrusion arranged between the first extrusion and the second extrusion.

Other objectives and advantages besides those described above will be apparent to those skilled in the art from the description of a preferred embodiment of the invention which follows. In the description, reference is made to accompanying drawings, which form a part hereof, and which illustrate examples of the invention. Such examples, however, are not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, description will be made of the embodiments in accordance with the present invention.

(First Embodiment)

Figure 1:
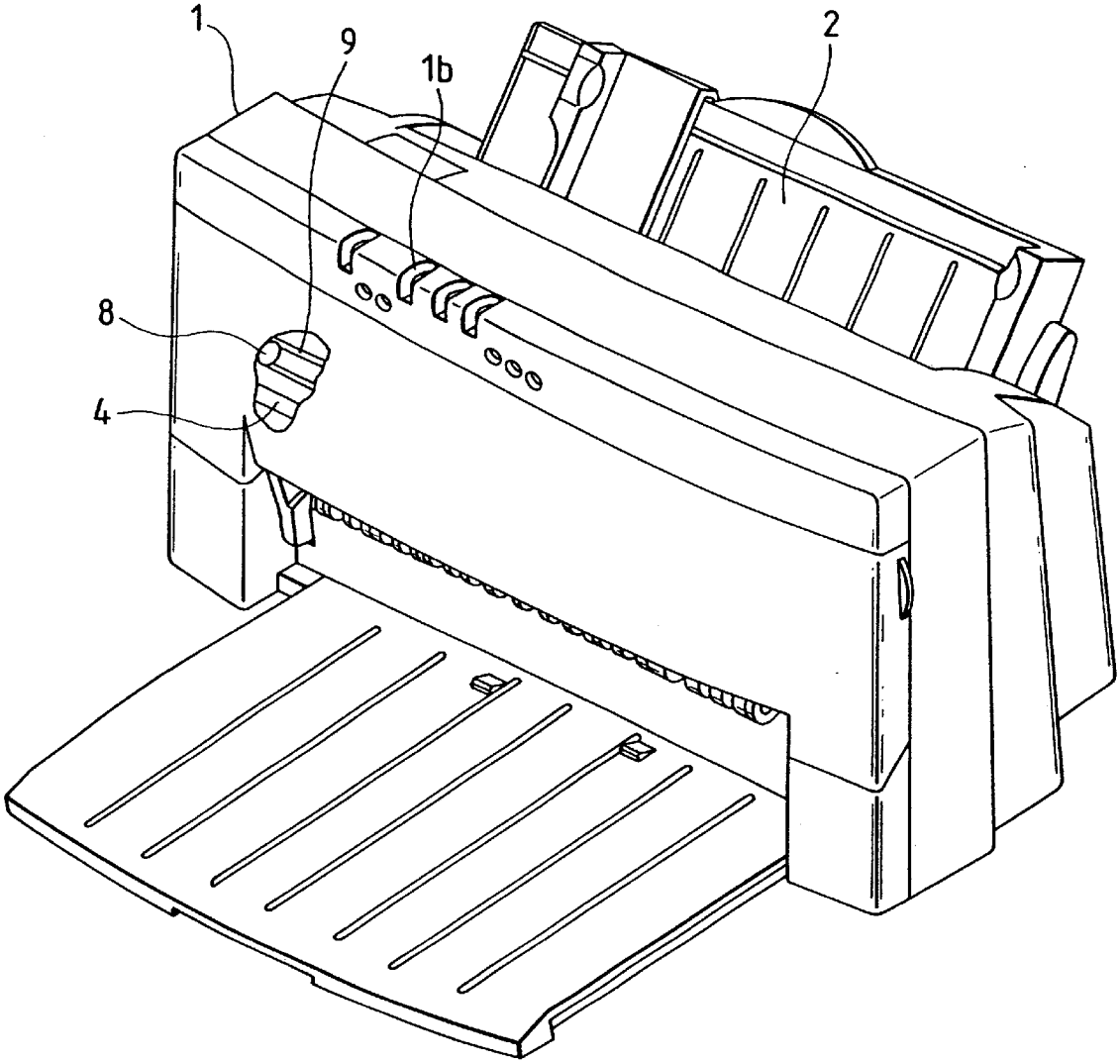
FIG. 1 is a view which shows the entire structure of an ink jet recording apparatus in accordance with a first embodiment of the present invention.
Figure 2:
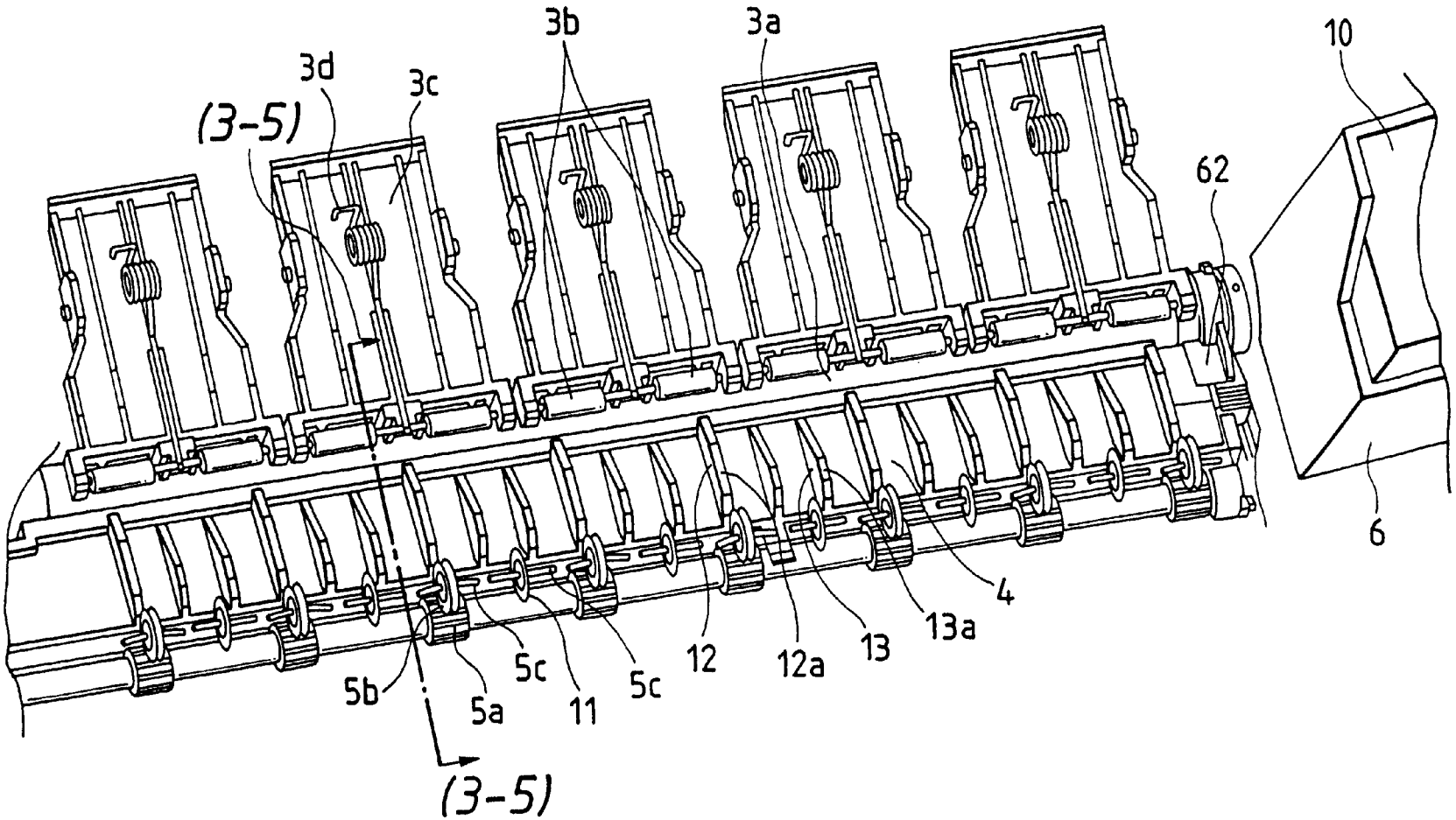
FIG. 2 is a perspective view which shows the principal part of the recording unit of the ink jet recording apparatus.

FIG. 1 is a view which shows the entire structure of an ink jet recording apparatus in accordance with a first embodiment of the present invention. FIG. 2 is a perspective view which shows the principal part of the recording unit of the ink jet recording apparatus of the present embodiment. FIG. 3 to FIG. 8 are schematic views of the recording unit for the illustration of the states of a sheet at the time of recording.

<The Entire Structure>

The ink jet recording apparatus shown in FIG. 1 is arranged to separate and carry sheets P set on a feed and carrier tray 2 one by one by use of a pick up roller (not shown), and at the same time, to convey the sheet onto a platen 4 by use of carrier roller pairs 3 including a carrier roller 3*a* and pinch rollers 3*b,* which serve as a first sheet carrier means.

Figure 3:
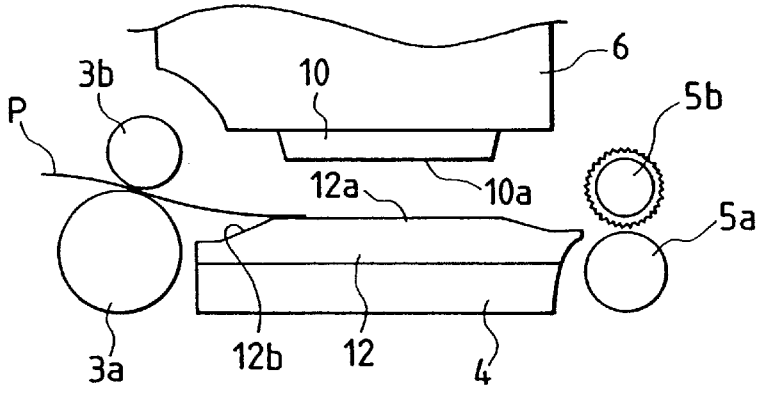
FIG. 3 is a side view which shows the recording unit to illustrate the state of a sheet at the time of recording.
Figure 4:
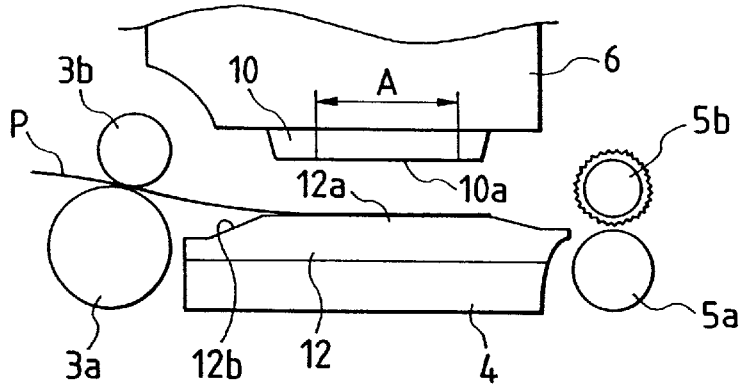
FIG. 4 is a side view which shows the recording unit to illustrate the state of a sheet at the time of recording.
Figure 5:
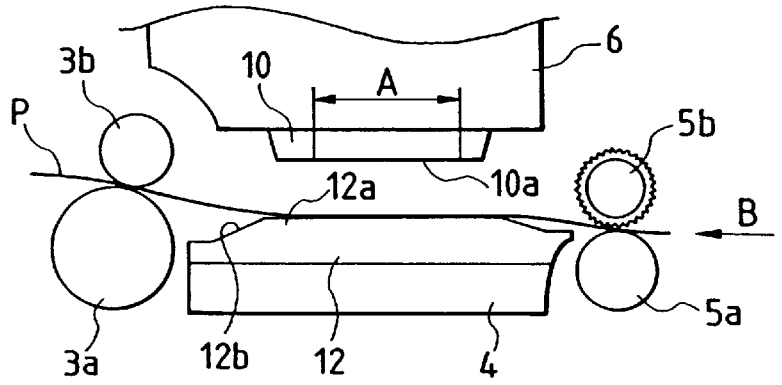
FIG. 5 is a side view which shows the recording unit to illustrate the state of a sheet at the time of recording.

As shown in FIG. 2, each of the pinch rollers 3*b* of the carrier roller pairs 3, which receives a biasing force from one of pinch roller springs 3*d* through one of pinch roller holders 3*c,* is biased to the carrier roller 3*a*. Thus, each of the pinch rollers 3*b* is able to follow the rotation of the carrier roller 3*a* to pinch and carry the sheet P. At this juncture, each pinch roller 3*b* is biased to the carrier roller 3*a* in a position offset to the downstream side in the sheet conveying direction as shown in FIG. 3. Therefore, as shown in FIG. 4 and FIG. 5, the leading end of the sheet P is eventually conveyed diagonally downward.

On the surface of the platen 4, extrusions are arranged extensively in two kinds of configurations in the conveying direction of the sheet P, or preferably, in parallel with the conveying direction thereof. Also, a plurality of extrusions are arranged on the platen 4 in a direction different from the conveying direction of the sheet P, or preferably, in the direction orthogonal to the conveying direction (see FIG. 6 and FIG. 7).

Figure 7:
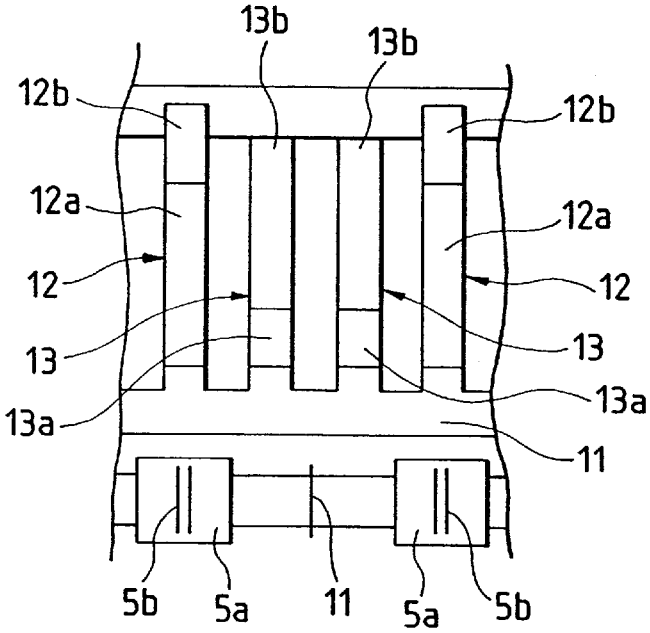
FIG. 7 is a plan view which shows the recording unit to illustrate the state of a sheet at the time of recording.

Each of ribs 12, which comprise first extrusions, is arranged on the upstream side of one of pairs of expelling rollers 5 formed by exhaust rollers 5*a* and spurs (members that rotate following the exhaust rollers) 5*b* (FIG. 7). Also, ribs 13, which comprise second extrusions, are arranged on both sides of an extended line of each of biased spurs 11 on the upstream side in the conveying direction of the sheet P (FIG. 7). The ribs 12 and 13 are provided with planar portions 12*a* and 13*a,* respectively, positioned substantially equidistant from each of ink discharge ports arranged on a discharge port surface 10*a* of a cartridge 10 mounted on a carriage 6. Each rib is also provided with a surface 12*b,* 13*b* inclined toward platen 4 and away from the discharge port surface 10*a* toward the upstream side relative to the sheet conveying direction.

Figure 8:
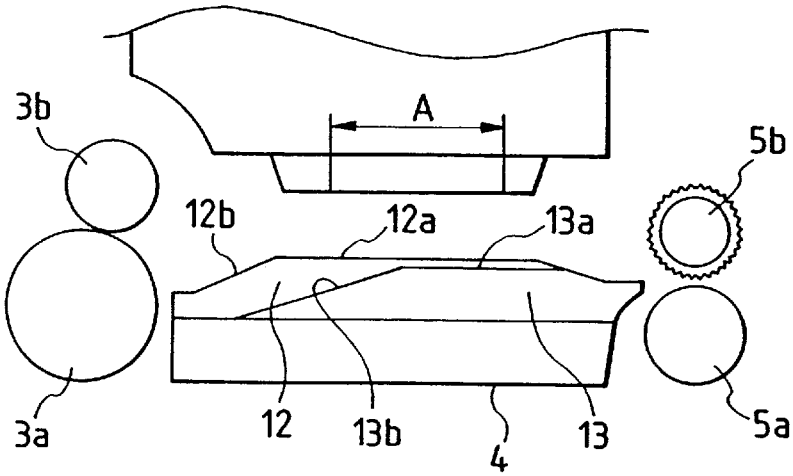
FIG. 8 is a side view which shows the recording unit to illustrate two kinds of ribs.

Also, as shown in FIG. 7 and FIG. 8, which illustrate the two kinds of ribs in detail, the flat planar portion 12*a* of the rib 12 is formed to be equal to or longer than region A (namely, the ink jet recordable area), which is the area where ink droplets are allowed to adhere on the sheet when discharged from a plurality of ink discharge ports arranged on the discharge port surface 10*a* of the cartridge 10 mounted on the serially traveling carriage 6. On the other hand, the flat planar portion 13*a* of the rib 13 is formed to be shorter than the region A, which is the ink jet recordable area.

Further, the inclined portion 13*b* of each rib 13 (which is inclined toward the platen 4 and away from the discharge port surface 10*a* toward the upstream side relative to the sheet conveying direction in the same manner as the inclined portion of each rib 12) is formed more moderately than the inclined portion 12*b* of each rib 12.

Ribs 12 and 13 are arranged in the direction different from the conveying direction of the sheet P as described above (in the direction orthogonal to the conveying direction of the sheet P, for example). However, as shown in FIG. 8, the rib 13 is arranged so that the flat plane 13*a* and the inclined portion 13*b* are allowed to face the region A in the position where the flat planar portion 12*a* of each rib 12 faces the entire region A which serves as the ink jet recordable area, when observed in the direction orthogonal to the conveying direction of the sheet P.

Here, the structure is arranged so that after a specific recording is made by use of the cartridge 10, which serves as ink jet recording means on the platen 4, the sheet P is expelled by use of pairs of expelling rollers, that is, second sheet conveying means, each formed by an exhaust roller 5*a* and a spur 5*b,* which is the member that rotates following the exhaust roller. The spur 5*b* is pressed to the exhaust roller 5*a* by the application of a biasing force of a spring shaft 5*c* fixed to the spur holder (not shown), and pinches the sheet P to convey it by following the exhaust roller 5*a* driven to rotate.

Between pairs of expelling rollers 5, there are arranged a plurality of biasing spurs 11, which are biased members that rotate following the exhaust rollers. The biased spurs 11 bias the sheet P in the direction away from the cartridge 10 by the application of the biasing force of the spring shaft 5*c* in the same manner as the spurs 5*b*.

In this respect, each of the spurs 5*b* and the biased spurs 11 is formed of material having a high water-repellency, and is in contact with the recorded surface of the sheet P only with its circumferential edge. Thus, each spur can operate to pinch and convey the sheet without affecting the images yet to be fixed thereon immediately after recording.

Recording is made on the sheet P conveyed on the platen 4 by recording means. For the present embodiment, the serial type ink jet recording method is adopted for the recording means, and the carriage 6 is slidably held at a position to face the platen 4 by a guide shaft 7 to be able to reciprocate in the direction orthogonal to the conveying direction of the sheet P. On the carriage 6, a timing belt 9 is tensioned around the pulley 8 to be driven by a carriage motor (not shown), and in accordance with the recording operation, the carriage motor is energized to enable the carriage 6 to reciprocate in the main scanning direction.

On the carriage 6, the ink jet cartridge (hereinafter referred to as a cartridge 10 simply), which is integrally formed with an ink tank and a recording head, is detachably mounted. The recording head is provided with the discharge port surface 10*a* to face the platen 4, and at the same time, the head is arranged to discharge liquid ink from the discharge ports onto the sheet P for recording along with the traveling of the carriage 6 in accordance with recording signals transmitted to the recording head. Here, for the carriage 6, it may be possible to adopt the mode in which only the ink jet recording head is installed or the mode in which the ink jet recording head and the ink tank are installed as separate members, but joined together on the carriage 6.

The ink jet recording head is provided with fine liquid discharge ports (orifices), liquid paths, energy activation units each arranged for a part of each liquid path, and energy generating means for generating energy to act on liquid in each activating unit to form liquid droplets. For the recording method using such energy generating means, there is, among others, the method in which electromechanical transducing members, such as piezo elements, are adopted, the method in which laser or some other electromagnetic waves are irradiated to generate heat for the discharge of liquid droplets, or the method in which liquid is heated by use of electrothermal transducing members, such as heat generating elements provided with heat generating resistors.

Among those methods, the recording head that adopts the ink jet recording method of discharging liquid by the application of thermal energy makes it possible to arrange the liquid discharge ports (orifices) in high density to form discharged recording liquid droplets for recording in high resolution. With such a method, it is easier to make the recording head more compact by using electrothermal transducing members as energy generating means, and it is possible for the manufacture of such a head by fully utilizing the IC technologies and micromachining technologies and techniques which have achieved remarkable technical advancement and enhancement of reliability in the semiconductor field in recent years. As a result, it becomes possible to perform highly densified assembling of the head at lower costs of manufacture, among many advantages.

For the ink discharge in the present embodiment, the structure is arranged so that the electrothermal transducing members are energized in accordance with recording signals, and then, ink is discharged from the discharge ports for recording by the development and contraction of bubbles created in ink by the utilization of film boiling in ink by the application of thermal energy thus generated.

[Operation]

Now, in conjunction with FIG. 3 to FIG. 7, description will be made of the state of the sheet P before and after recording. FIG. 3 to FIG. 5 are cross-sectional views taken along line (3-5)—(3-5) in FIG. 2, and depict up to the state where the leading end of the sheet P conveyed diagonally downward by means of the carrier roller pair 3 has passed a pair of expelling rollers 5.

At first, as shown in FIG. 3, when the sheet P is conveyed by the carrier roller pair 3, it is directed diagonally downward, because the pinch roller 3*b* is arranged to be offset to the downstream side in the sheet conveying direction with respect to the carrier roller 3*a*. Thus, the reverse side of the leading end of the sheet P abuts upon the flat plane 12*a* of each rib 12 assuredly.

Then, as shown in FIG. 4, the sheet P is further conveyed to the starting position of recording. Here, the reverse side of the leading end of the sheet P is still in contact with the flat plane 12*a,* and the sheet P is substantially in parallel with the discharge port surface 10*a* in a position to face the region A, which is the ink jet recordable area. Therefore, on the upstream side and downstream side in the sheet conveying direction, the distance in which the ink is discharged from the discharge port of the cartridge 10 and impacted on the sheet P is substantially the same, and there is no fear that color deviation takes place due to the deviation of impacted positions.

When the sheet P is further conveyed from the state described above, the leading end of the sheet P is in the state where it has passed a pair of expelling rollers 5 as shown in FIG. 5. In this case, the carrier speed of the exhaust roller 5 is set to be slightly faster than that of the carrier roller pair 3. As a result, the sheet P is in a state where it is slightly tensioned by means of the carrier roller pair 3 and the exhaust roller pair 5.

In this state, too, the reverse side of the sheet P is in contact with the flat plane 12*a,* and positioned to face the region A, which is the ink jet recordable area, so that the discharge port surface 10*a* and the sheet P are substantially parallel. In this case, too, therefore, the distance in which the ink is discharged from the discharge port of the cartridge 10 and impacted on the sheet P becomes substantially the same on the upstream side and downstream side relative to the sheet conveying direction, and there is no fear that color deviation takes place due to the deviation of impacted positions. Also, before and after having passed a pair of expelling rollers 5, the sheet P presents substantially the same distance between the recording surface and the discharge port surface 10*a,* hence making it possible to minimize degradation of recording.

Figure 6:
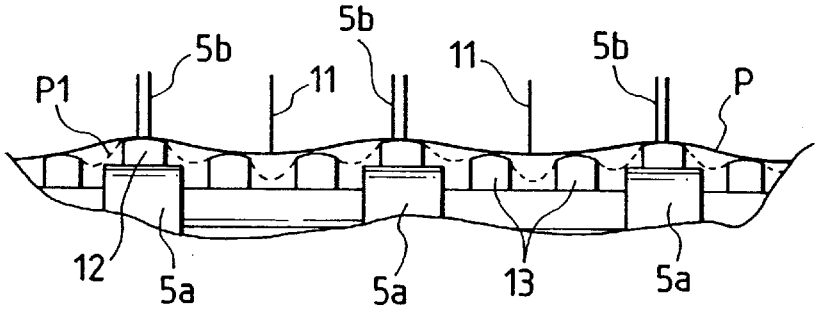
FIG. 6 is a front view which shows the recording unit to illustrate the state of a sheet at the time of recording.

FIG. 6 is a view taken in the direction indicated by the arrow B in FIG. 5 to represent the recording unit observed from the side of the pair of expelling rollers. As shown in FIG. 6, the sheet P is forced downward like a valley by the function of the biased spurs 11, and undulated upward at each position of the flat plane 12*a* to form vertices of the undulation. Here, in order to form the stably moderate undulations, it is preferable to set each of the flat planes 13*b* of ribs 13 to be slightly lower than the height of each of flat planes 12*a*. Also, since the sheet P tends to curve downward on the extended line of each biased spurs 11 on the upstream side, it is better not to arrange ribs 13 there in order to stabilize the undulated condition of the sheet.

With the structure thus arranged, the sheet P swells when a great amount of ink is applied, and its size becomes larger if images are recorded in high density on a paper sheet P which is subjected to water absorption. Then, "cockling" occurs, that is, a condition in which the sheet P tends to be expanded in a direction where the amplitude of the undulated condition becomes larger, but now that the vertices on the cartridge 10 side are suppressed by the spurs 5*b* and the biased spurs 11, the sheet swells between the ribs 12 and 13 as indicated by broken lines P1 in FIG. 6. Here, with the provision of the ribs 13, the formation of larger undulations is suppressed even when the sheet P is swollen.

In this respect, if the flat plane 13*a* of each rib 13 should be formed to be equal to or longer than the region A serving as the ink jet recordable area as in the case of the flat plane 12*a* of each rib 12, the sheet P is biased by the biased spurs 11 in the direction away from the cartridge when the sheet P is conveyed and the reverse side thereof is supported by the ribs 13. As a result, the sheet P swells to the cartridge 10 side in each space (the space between each of the ribs 13) positioned on the upstream side of the extended lines from the biased spurs 11. Thus, there is a fear that the sheet P is allowed to contact the ink discharge ports.

However, in accordance with the present embodiment, each of the inclined surfaces of ribs 13 is formed from the portion where it faces the region A serving as the ink jet recordable area, and the flat plane 13*a* of each rib 13 is formed to be shorter than the flat plane 12*a* of each rib 12. Therefore, even if the sheet P is biased by each of the biased spurs 11 in the direction away from the cartridge 10, it becomes possible to suppress the swelling of the sheet P toward the cartridge 10 side in each space (space between each of ribs 13) positioned on the upstream side of the extended lines from the biased spurs 11.

As described above, in accordance with the present embodiment, it becomes possible to make the distance from the discharge port surface 10*a* of the cartridge 10 to the facing sheet P substantially equal on the upstream side and downstream side relative to the sheet conveying direction by means of the flat plane 12*a* of each rib 12. Also, by forming the flat plane 13*a* of each rib 13 to be shorter than the flat plane 12*a* of each rib 12, it becomes possible to allow the swelling of the sheet P due to cockling to escape smoothly even in the vicinity of the pair of expelling rollers.

(Second Embodiment)

Figure 9:
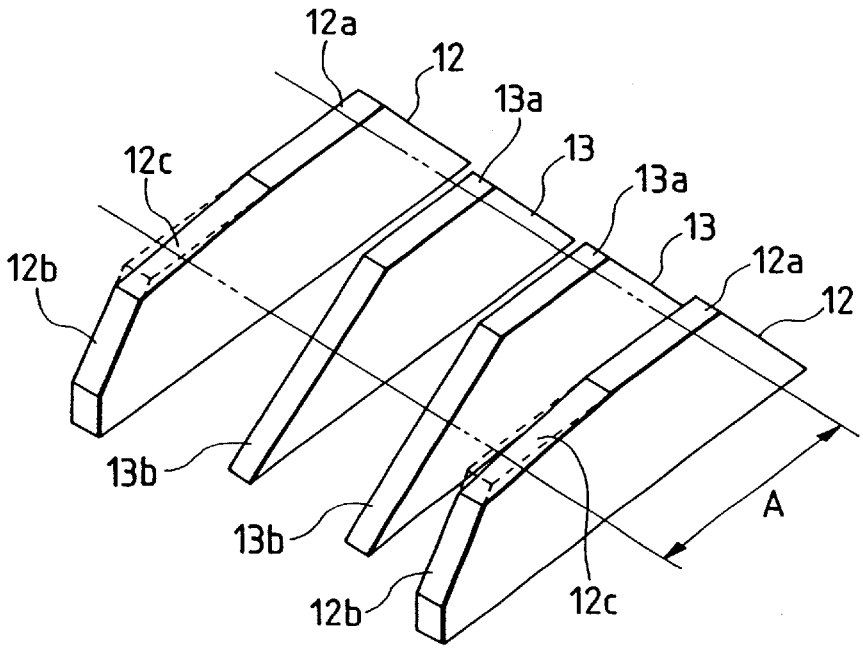
FIG. 9 is a perspective view which shows the recording unit in accordance with a second embodiment of the present invention.

Now, with reference to the accompanying drawings, the description will be made of a second embodiment in accordance with the present invention. FIG. 9 is a perspective view which shows the recording unit in accordance with the present embodiment. The same reference numerals are used for the same parts which overlap with the corresponding description of the first embodiment, and description thereof will be omitted.

For the first embodiment, description has been made of the case where the flat plane 12*a* of each rib 12 on the upstream side in the sheet conveying direction of the pair of expelling rollers 5 is made longer than the flat plane 13*a* of each rib 13 on the upstream side of each biased spur 11. For the present embodiment, however, the moderately inclined surface 12*c* is formed for the flat plane 12*a* on the upstream side of the sheet conveying direction as shown in FIG. 9.

The inclined surface 12*c* is formed more moderately than the inclined surface 13*b* of each rib 13 at an angle of inclination within a range that does not affect the recording condition on the sheet P. With the structure thus arranged, it becomes easier for the sheet P conveyed diagonally downward from the carrier roller pair 3 to run along each of ribs 12, and at the same time, it becomes possible to make the distance from the discharge port surface 10*a* of the cartridge 10 to the facing sheet P substantially equal on the upstream side and downstream side in the sheet conveying direction.

(Third Embodiment)

Figure 10:
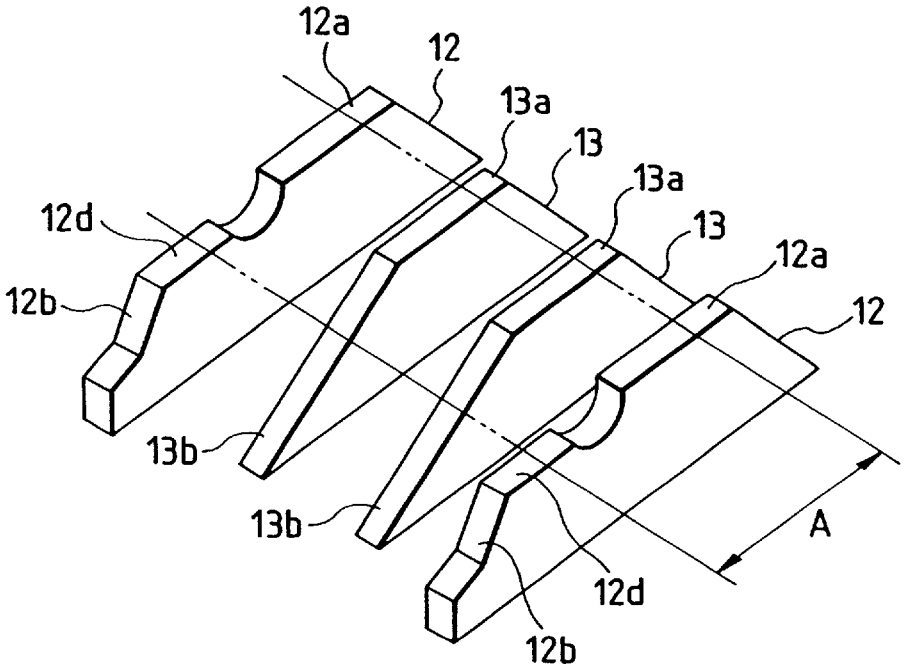
FIG. 10 is a perspective view which shows the recording unit in accordance with a third embodiment of the present invention.

Now, with reference to the accompanying drawings, description will be made of a third embodiment in accordance with the present invention. FIG. 10 is a perspective view which shows the recording unit of the third embodiment. The same reference numerals are used for the same parts which overlap with the corresponding descriptions of the first embodiment. Description thereof will be omitted.

In accordance with the present embodiment, flat plane 12*d* is formed substantially at the same height as that of the flat plane 12*a* of each rib 12 on the inclined surface 12*b* of each rib 12. In this way, it becomes possible to make the distance from the discharge port surface 10*a* of the cartridge 10 to the facing sheet P substantially equal in the upstream side and downstream side in the sheet conveying direction, as in the first and second embodiments.

In this respect, the flat plane 12*d* is made higher than the inclined portion 13*b* of each rib 13. Further, it is not needed to make this plane the same height as that of the flat plane 12*a* if the height is set within a range that does not affect the recording condition. Also, it is possible to obtain the same effect even if plane 12*d* is inclined to the upstream side in the sheet conveying direction within a range that does not affect the recording condition.

(Fourth Embodiment)

For each of the embodiments described above, description has been made of the difference in the configurations of each rib 12 on the upstream side of the pair of expelling rollers 5, and each rib 13 on both sides upstream of each biased spur 11. The same effect can be achieved by applying these differences complexly for two kinds or more.

Also, for each of the embodiments described above, description has been made of the case where the pair of expelling rollers 5 and the biased spurs 11 are provided. It is still possible to obtain the same effect even without the presence of the pair of expelling rollers if the structure is arranged as described earlier, but only the pair of expelling rollers 5 are removed from such structure.

Also, even in a case where the cockling is controlled by some other method, it is possible to make the distance substantially equal between the discharge ports of ink jet recording means and the sheet which is supported by the flat plane of the platen in the sheet conveying direction if the platen is structured in accordance with the present embodiment.

Further, for each of the embodiments described above, the structure has been made so that the discharge port surface 10*a* and the flat planes 12*a* and 13*a* are substantially parallel with each other in order to make the distance substantially constant between the discharge ports of the discharge port surface 10*a* and each of the flat planes 12*a*, as well as to make the distance substantially constant between the discharge ports of the discharge port surface 10*a* and each of the flat planes 13*a*. For example, however, if the discharge port surface is inclined to the direction orthogonal to the sheet conveying direction, or in a similar case where the discharge port surface 10*a* is not in parallel with each of the flat planes 12*a* and 13*a,* it is still possible to obtain the same effect with the provision of the flat plane portion that makes each distance substantially constant between the discharge port surface 10*a* and each of the flat planes 12*a* and 13*a*.

(Fifth Embodiment)

Now, description will be made of the case in which, among a plurality of ribs on the platen, the structure, which has been described for any one of the first to fourth embodiments, is adopted for the ribs other than those on both end portions, and at the same time, there are provided on both end portions ribs 61*a,* 61*b,* and 61*c,* which are structured to suppress the bending of the end portion of the sheet P to the ink discharge port side.

Figure 11:
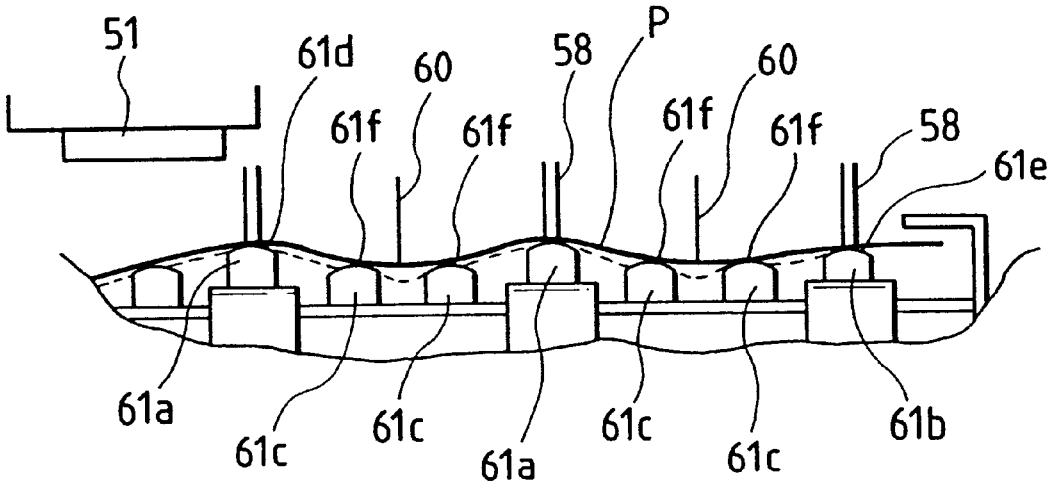
FIG. 11 is a view which shows the recording unit represented in FIG. 5, observed in the direction indicated by an arrow B.

FIG. 11 is a view in the direction of arrow B in FIG. 5. The recording sheet P is conveyed onto the flat plane 61*d* of each rib 61*a,* but the recording sheet P is biased by each of the biased spurs 60 to each rib 61*c* between ribs 61*a*. Therefore, in the width direction of the recording sheet P, each of the portions pressed by each biased spur 60 becomes a valley, and each portion that is in contact with the flat plane 61*d* of each rib 61 becomes a vertex, hence forming slight undulations in the sheet. The height of the flat plane 61*f* of each rib 61*c* is set to be lower than the height of the flat plane 61*d* of each rib 61*a*. Thus, the undulated condition of the recording sheet P is made more stable. Also, as described above, the length of the flat plane 61*f* of each rib 61*c* is shorter than the flat plane 61*d* of each rib 61*a* in the conveying direction of the recording sheet P. Accordingly, the structure is arranged so that the flat plane 61*f* of each rib 61*c* is not present at the upstream portion of the flat plane 61*d* of each rib 61*a*. In this manner, the undulations of the recording sheet P are stable.

Also, the height of the flat plane 61*e* of the rib 61*b* is set to be equal to or slightly higher than that of the flat plane 61*f* of each rib 61*c*. In this way, the rib 61*b* prevents the leading end of the recording sheet P from falling largely in the direction away from the ink jet recording head 51. Further, the height of the flat plane 61*e* of the rib 61*b* is set to be lower than that of the flat plane 61*d* of each rib 61*a* so as to suppress the bending of the end portion of the recording sheet P toward the ink jet recording head 51 side, which may take place when the rib 61*b* abuts upon the non-recording surface of the recording sheet P in the vicinity of the end portion.

In this state, if recording is made with highly concentrated ink on a recording sheet, such as paper having water absorption, the recording sheet P is conditioned to receive a great amount of ink using water as its solvent. As a result, the size of the sheet becomes larger. In this case, the recording sheet P tends to be expanded in the direction in which the amplitude of the undulations becomes larger. Now, however, the recorded surface of the recording sheet P (the surface that has absorbed ink discharged from the head) is pressed by the spurs 58 and biased spurs 60. Therefore, almost no swelling takes place toward the ink jet recording head 51 side, and, as shown in FIG. 11, the recording sheet is allowed to expand between the ribs 61*a,* and between the rib 61*a* and the rib 61*b,* in the direction away from the ink jet recording head 51 side.

Also, if the recording sheet P is swollen due to a great amount of ink thus received, larger swelling in the direction away from the ink jet recording head 51 is suppressed by the ribs 61*c* provided on both sides on the upstream side of the biased spurs 60 in the sheet conveying direction.

Further, as shown in the plan view of FIG. 7, the flat plane 61*f* (13*a*) of rib 61*c* (13) is structured to be shorter than the flat plane 61*d* (12*a*) of the rib 61*a* (12). Therefore, even if the recording sheet P is biased by the biased spurs 60 (11) in the direction away from the ink jet recording head 51, the recording sheet P is held at each inclined plane 13*b* (FIG. 7) of the rib 61*c* (13) eventually to make it possible to suppress the swelling of the recording sheet P between each of the ribs 13*b* toward the ink jet recording head 51 side.

As described above, in accordance with the present embodiment, the height of the flat plane 61*e* of the rib 61*b* is set to be equal to or slightly higher than that of the flat plane 61*f* of each rib 61*c*. In this way, the rib 61*b* prevents the leading end of the recording sheet P from falling largely in the direction away from the ink jet recording head 51. At the same time, it is made possible to suppress the bending of the end portion of the recording sheet P toward the ink jet recording head 51 side, which may take place when the rib 61*b* abuts upon the non-recording surface of the recording sheet P in the vicinity of the end portion. Consequently, there is no need for setting a gap between the ink jet recording head 51 and the recording sheet P more than necessary, while preventing a fear that the leading end of the recording sheet P is in contact with the ink jet recording head 51. Also, fine undulations are provided for the recording sheet P assuredly in advance, hence making it possible to prevent the recording sheet P from swelling toward the ink jet recording head 51 even if the recording sheet P has swollen by the absorption of ink.

Further, in a case where a floating regulation member 62 is provided for preventing the curling of the leading end of the recording sheet P toward the ink jet recording head 51 side, there is no need, either, for setting a gap between the floating regulation member 62 and the recording sheet P more than necessary, while making it possible to prevent a fear that the floating regulation member 62 is in contact with the leading end of the recording sheet P.

(Sixth Embodiment)

Figure 12:
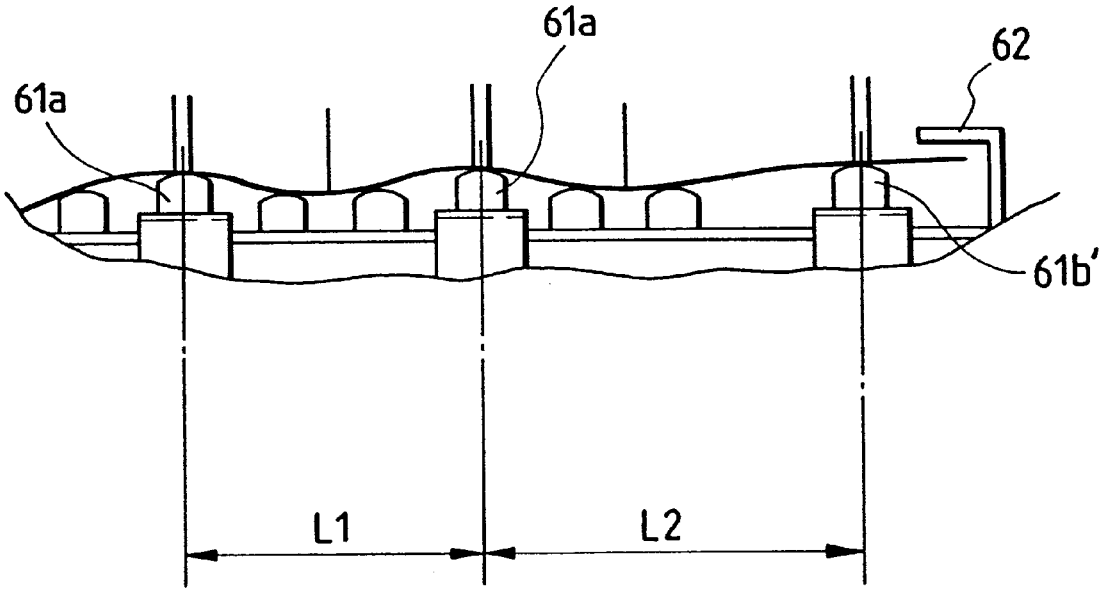
FIG. 12 is a view which shows the recording unit in accordance with a fourth embodiment of the present invention, corresponding to FIG. 10.
Figure 13:
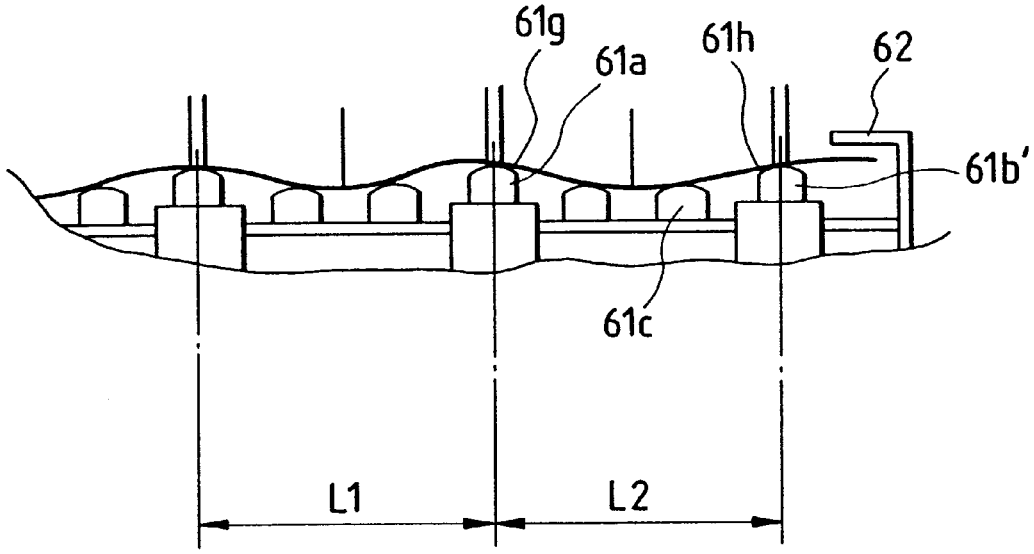
FIG. 13 is a view which shows the recording unit in accordance with a fifth embodiment of the present invention, corresponding to FIG. 10.

For the fifth embodiment, description has been made of the case where the height of the flat plane 61*e* of each rib 61*d* that supports the vicinity of the leading end of the recording sheet P is set to be equal to or slightly higher than the flat plane 61*f* of each rib 61*c,* and further, it is set to be lower than the height of. the flat plane 61*d* of each rib 61*a* on the side that serves as the reference to the set position thereof in the width direction of the recording sheet P. As shown in FIG. 12, however, it is still possible to obtain the same effect as the fifth embodiment by making the arrangement pitch L2 between the rib 61*a* and rib 61*b*' larger than the arrangement pitch L1 between each of the ribs 61*a* themselves, even if the rib 61*b*' is set to be substantially the same width and height of the rib 61*a*.

Also, even when the arrangement pitches L1 and L2 are substantially the same, it is possible to obtain the same effect as the fifth embodiment by effectuating an angle treatment on the edge line portion 61*h* of the inner side (the rib 61*c* side) of the rib 61*b*' with a larger chambering or rounding than the one given to the edge line portion 61*g* of the rib 61*a*.

Here, it is of course possible to obtain the same effect as described above even if the height of the rib 61*b*' is equal to the one described for the fifth embodiment when the arrangement pitches L1 and L2 are set or the angle treatment is given to the edge line portion 61*h* of the rib 61*b*' in accordance with the present embodiment.

(Seventh Embodiment)

Figure 14:
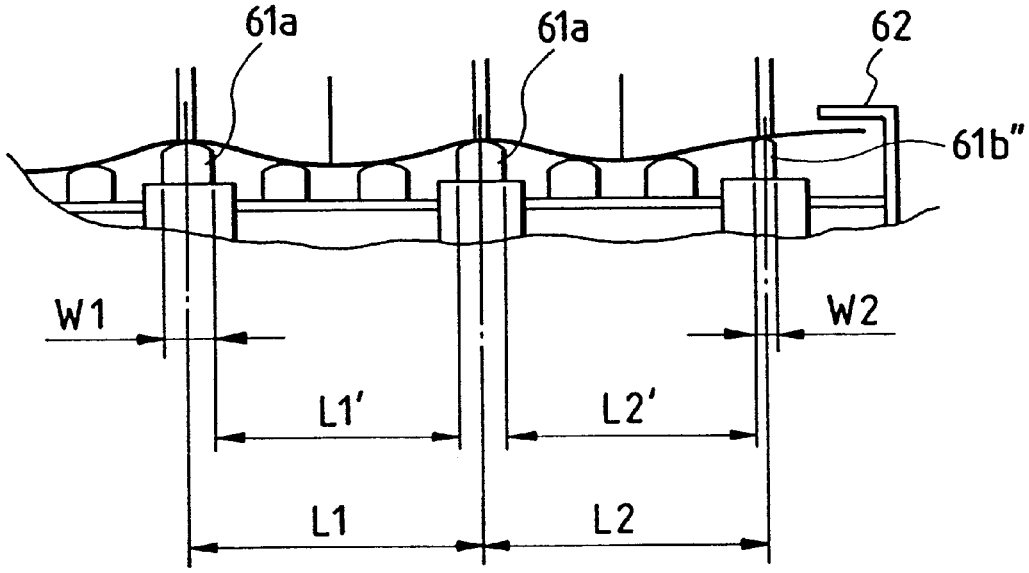
FIG. 14 is a view which shows the recording unit in accordance with a sixth embodiment of the present invention, corresponding to FIG. 10.
Figure 15:
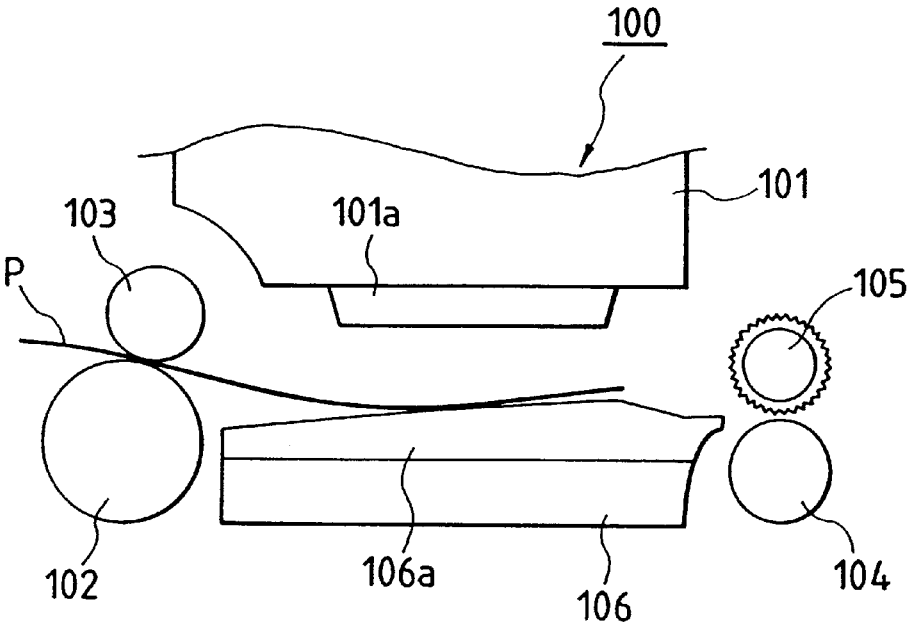
FIG. 15 is a view which shows the state of a recording sheet being conveyed by a conventional ink jet recording apparatus.
Figure 16:
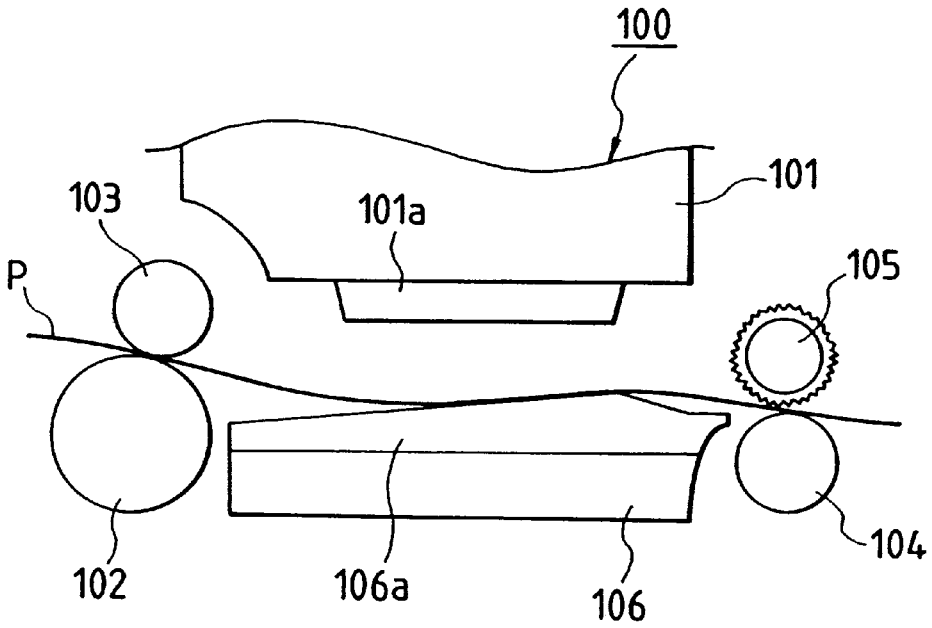
FIG. 16 is a view which shows the state of a recording sheet being conveyed further by the conventional ink jet recording apparatus.

For the fifth and sixth embodiments, description has been made of the case where the widths of the rib 61*a* and the rib 61*b* (61*b*') are substantially the same. As shown in FIG. 14, however, it is still possible to obtain the same effect as those embodiments described above even by making the arrangement pitch L2' between the rib 61*a* and 61*b*" wider than the pitch between each of the ribs 61*a* if the width W2 of the rib 61" is made smaller than the width W1 of the rib 61*a* with the arrangement pitches L1 between each of the ribs 61*a* being the same as the arrangement pitch L2 between the rib 61*a* and the rib 61*b*".

Although some embodiments of the present invention have been described so far, it is of course possible to obtain the same effect as described earlier by executing each of them individually or executing them in combination.

Also, in accordance with the fifth to seventh embodiments, description has been made of the rib 61*b* that supports the vicinity of the leading end of the recording sheet P on the reference side of the setting position in the width direction of the recording sheet P. It may be possible to obtain the same effect on the rib that supports the end portion of the recording sheet P on the side opposite to the one described earlier by effectuating the same setting as has been described up to now.

Also, in accordance with the fifth to seventh embodiments, description has been made of the case where the sheet exhaust roller and spur, and the biased spurs are arranged on the exhaust side of recording sheet P. However, even if these rollers and spurs are not present, it is possible to obtain the same effect by positioning and configuring the ribs as described earlier when the undulation phenomenon of the recording sheet P, which is caused by the absorption of ink into the recording sheet, is controlled by the functions of such ribs arranged for the platen.

Further, in accordance with the first to seventh embodiments, the structure is arranged to minimize the influence of cockling by extruding a plurality of ribs on the platen in the sheet conveying direction, hence making it possible to substantially equalize the distances between each of the flat planes of ribs that support the reverse side of the sheet, and each of the plural ink discharge ports arranged on the ink discharge port surface within the distance differential which is equivalent to the thickness of the sheet P. In this manner, the distance in which ink is discharged from each of the ink discharge ports and allowed to adhere to a sheet is made substantially constant between the ink discharge ports and the sheet on the upstream side, and between the ink discharge ports and the sheet on the downstream side in the sheet conveying direction, thus making it possible to obtain recorded images in good condition without the creation of color deviations or the like.

Also, in accordance with each of the above embodiments, the recording apparatus has been described as an ink jet recording apparatus. However, the present invention is applicable to recording apparatuses other than the ink jet recording apparatus. In other words, for a recording apparatus capable of creating fine undulations on a recording sheet P in advance by use of a plurality of ribs arranged for the platen for the purpose of giving firmness to a recording sheet P or the like, it is possible to obtain the same effect if the ribs are positioned and configured in the same manner as has been described above.

What is claimed is:

1. An ink jet recording apparatus using ink to be discharged from a plurality of ink discharge ports of recording means, said apparatus comprising:

holding means for holding the recording means for recording on a recording sheet;

conveying means for conveying the recording sheet in a conveying direction; and a recording sheet supporting member arranged in a position to face the recording means, said supporting member comprising a supporting surface to support the non-recording surface of the recording sheet, and being arranged in a direction intersecting the conveying direction of the recording sheet, said supporting surface comprising a first extrusion and a second extrusion extended in the conveying direction of the recording sheet, and including inclined surfaces that slope toward said holding means along the conveying direction, and angles of inclination being different for the inclined surfaces of said first extrusion and said second extrusion.

2. An ink jet recording apparatus according to claim 1, wherein the angle of inclination of said second extrusion is smaller than the angle of inclination of said first extrusion.

3. An ink jet recording apparatus according to claim 1 or claim 2, wherein said supporting surface defined by said first extrusion and said inclined surface of said second extrusion are positioned to face the plurality of ink discharge ports of the recording means supported by said holding means.

4. An ink jet recording apparatus according to claim 3, wherein a third extrusion is provided at a region between said first extrusion and said second extrusion, and an exhaust rotary member is provided to contact a recording surface of the recording sheet downstream of the recording means in the conveying direction at the region or an imaginary extension thereof.

5. An ink jet recording apparatus according to claim 4, wherein said recording means comprises ink jet recording means for discharging ink from the ink discharge ports by use of thermal energy.

6. An ink jet recording apparatus according to claim 3, wherein an exhaust rotary member is provided to contact a recording surface of the recording sheet downstream of the recording means in the conveying direction at a region between said first extrusion and said second extrusion or between imaginary extensions thereof.

7. An ink jet recording apparatus according to claim 6, wherein said recording means comprises ink jet recording means for discharging ink from the ink discharge ports by use of thermal energy.

8. An ink jet recording apparatus according to claim 3, wherein said recording means comprises ink jet recording means for discharging ink from the ink discharge ports by use of thermal energy.

9. An ink jet recording apparatus according to claim 1 or claim 2, wherein said recording means comprises ink jet recording means for discharging ink from the ink discharge ports by use of thermal energy.

10. An ink jet recording apparatus according to claim 1 or 2, wherein a third extrusion is provided at a region between said first extrusion and said second extrusion, and an exhaust rotary member is provided to contact a recording surface of the recording sheet downstream of the recording means in the conveying direction at the region or an imaginary extension thereof.

11. An ink jet recording apparatus according to claim 10, wherein said recording means comprises ink jet recording means for discharging ink from the ink discharge ports by use of thermal energy.

12. An ink jet recording apparatus according to claim 1 or 2, wherein an exhaust rotary member is provided to contact a recording surface of the recording sheet downstream of the recording means in the conveying direction at a region between said first extrusion and said second extrusion or between imaginary extensions thereof.

13. An ink jet recording apparatus according to claim 12, wherein said recording means comprises ink jet recording means for discharging ink from the ink discharge ports by use of thermal energy.

14. A recording apparatus provided with holding means for holding recording means for recording on a recording sheet and conveying means for conveying the recording sheet, said apparatus comprising:

a recording sheet supporting member arranged in a position to face the recording means, said supporting member being provided with a plurality of extrusions to support the non-recording surface of the recording sheet conveyed by the conveying means, said plurality of extrusions comprising a first extrusion arranged to support an end portion of the recording sheet in the recording sheet width direction and being positioned at an endmost position of said plurality of extrusions in the recording sheet width direction, and a plurality of second extrusions arranged to convexly support a part of the recording sheet in the width direction toward the recording means, wherein the height of said first extrusion is lower than the heights of said second extrusions.

15. A recording apparatus according to claim 14, wherein the edge line portion of said first extrusion on a side of said second extrusions is chamfered or rounded larger than the edge line portions of said second extrusions.

16. A recording apparatus according to claim 14, wherein the width of said first extrusion is smaller than the width of each of said second extrusions.

17. A recording apparatus according to claim 14, wherein the arrangement pitch between said first extrusion and one of said second extrusions most adjacent to said first extrusion is larger than the arrangement pitch between said second extrusions.

18. A recording apparatus provided with holding means for holding recording means for recording on a recording sheet and conveying means for conveying the recording sheet, said apparatus comprising:

a recording sheet supporting member arranged in a position to face the recording means, said supporting member being provided with a plurality of extrusions to support the non-recording surface of the recording sheet conveyed by the conveying means, said plurality of extrusions comprising a first extrusion arranged to support a side end portion of the recording sheet in the conveying direction of the recording sheet and being positioned at an endmost position of said plurality of extrusions in the recording sheet width direction, a plurality of second extrusions arranged to convexly support a part of the recording sheet in the width direction toward the recording means, and a third extrusion arranged between said first extrusion and one of said second extrusions, wherein the height of said first extrusion is lower than the heights of said second extrusions.

19. A recording apparatus according to claim 18, wherein the edge line portion of said first extrusion on a side of said second extrusions is chamfered or rounded larger than the edge line portions of said second extrusions.

20. A recording apparatus according to claim 18, wherein the width of said first extrusion is smaller than the width of each of said second extrusions.

21. A recording apparatus according to claim 18, wherein the height of said third extrusion is lower than those of said second extrusions, and a shape of said first extrusion is the same as that of said third extrusion.

22. A recording apparatus according to claim 18, wherein the height of said third extrusion is lower than the heights of said second extrusions, and the height of said first extrusion is more than the height of said third extrusion.

23. A recording apparatus according to claim 18, wherein said conveying means comprises a plurality of roller pairs for pinching and conveying the recording sheet downstream of said recording sheet supporting member relative to the conveying direction of the recording sheet, and biasing means arranged between said plurality of roller pairs for biasing the recording sheet toward said recording sheet supporting member, and each of said second extrusions is arranged upstream of said plurality of roller pairs, respectively, and said third extrusion is arranged in the vicinity of the upstream side of said biasing means.

24. A recording apparatus according to claim 18, wherein the arrangement pitch between said first extrusion and one of said second extrusions most adjacent to said first extrusion is larger than the arrangement pitch between said second extrusions.

25. A recording apparatus according to claim 18, wherein a regulating unit for regulating floating of an end portion of the recording sheet in the width direction is arranged in the vicinity of an end portion of said recording sheet supporting member.

26. A recording apparatus according to claim 18, wherein said recording means comprises an ink jet recording head for recording by discharging ink to the recording sheet in accordance with image information.

27. An ink jet recording apparatus using ink to be discharged from a plurality of ink discharge ports of a recording head, said apparatus comprising:

a holding member for holding the recording head for recording on a recording sheet;

a conveying mechanism for conveying the recording sheet in a conveying direction; and a recording sheet supporting member arranged in a position to face said holding member, said supporting member comprising a first extrusion and a second extrusion extended in the conveying direction of the recording sheet, and including inclined surfaces that slope toward said holding member along the conveying direction, and angles of inclination being different for the inclined surfaces of said first extrusion and said second extrusion.

28. An ink jet recording apparatus according to claim 27, wherein the angle of inclination of said second extrusion is smaller than the angle of inclination of said first extrusion.

29. An ink jet recording apparatus using ink to be discharged from a plurality of ink discharge ports of a recording head, said apparatus comprising:

a holding member for holding the recording head for recording on a recording sheet;

a conveying mechanism for conveying the recording sheet in a conveying direction; and a recording sheet supporting member arranged in a position to face said holding member, said supporting member comprising a first extrusion and a second extrusion extended in the conveying direction of the recording sheet, a distance between a leading end of said first extrusion and said holding member being different from a distance between a leading end of said second extrusion and said holding member when each of the leading ends of said first extrusion and said second extrusion is opposed to said holding member.

30. An ink jet recording apparatus according to claim 29, wherein the angle of the inclination of said second extrusion that slopes toward said holding member along the conveying direction is smaller than that of said first extrusion.

* * * * *